United States Patent [19]

Arena

[11] 4,316,493

[45] Feb. 23, 1982

[54] VERTICAL BLIND CONTROLS

[76] Inventor: Joseph P. Arena, 254-43 Pembroke Ave., Great Neck, N.Y. 11020

[21] Appl. No.: 824,834

[22] Filed: Aug. 15, 1977

[51] Int. Cl.[3] ..... E06B 9/30

[52] U.S. Cl. ..... 160/168 R

[58] Field of Search ..... 160/166–178

[56] References Cited

U.S. PATENT DOCUMENTS

| | | | |
|---|---|---|---|
| 3,134,428 | 5/1964 | Kehrer et al. | 160/172 |
| 3,269,453 | 8/1966 | Vecchiarelli et al. | 160/176 |
| 3,343,588 | 9/1967 | Cayton | 160/176 |
| 3,463,219 | 8/1969 | Osterholz | 160/172 |
| 3,605,852 | 9/1971 | Vecchiarelli | 160/176 |

*Primary Examiner*—Peter M. Caun

*Attorney, Agent, or Firm*—Kenyon & Kenyon, Reilly, Carr & Chapin

[57] ABSTRACT

Vertical blinds having commonly housed and traversely movable controls for controlling the traverse and rotation of the vanes are disclosed. In a disclosed embodiment, the vanes are supported by carrier members, and a rotation rod extends through the carrier members. The carrier members are slideable along the rotation rod. A control assembly is mounted to slide along and also rotate the rotation rod. Sliding of the control assembly along the rotation rod slides the carrier members to thereby traverse the vanes, and actuation of the control assembly rotates the rotation rod and the vanes. The control assembly includes meshing bevel gears, one of which is coupled to an actuating rod or wand and the other to the rotation rod whereby rotation of the wand causes rotation of the vanes. The control assembly is slid by means of the wand which is universally connected to the control assembly. The wand is thus a unitary control for actuating both traverse and rotation of the vanes.

14 Claims, 7 Drawing Figures.

Fig. 1.
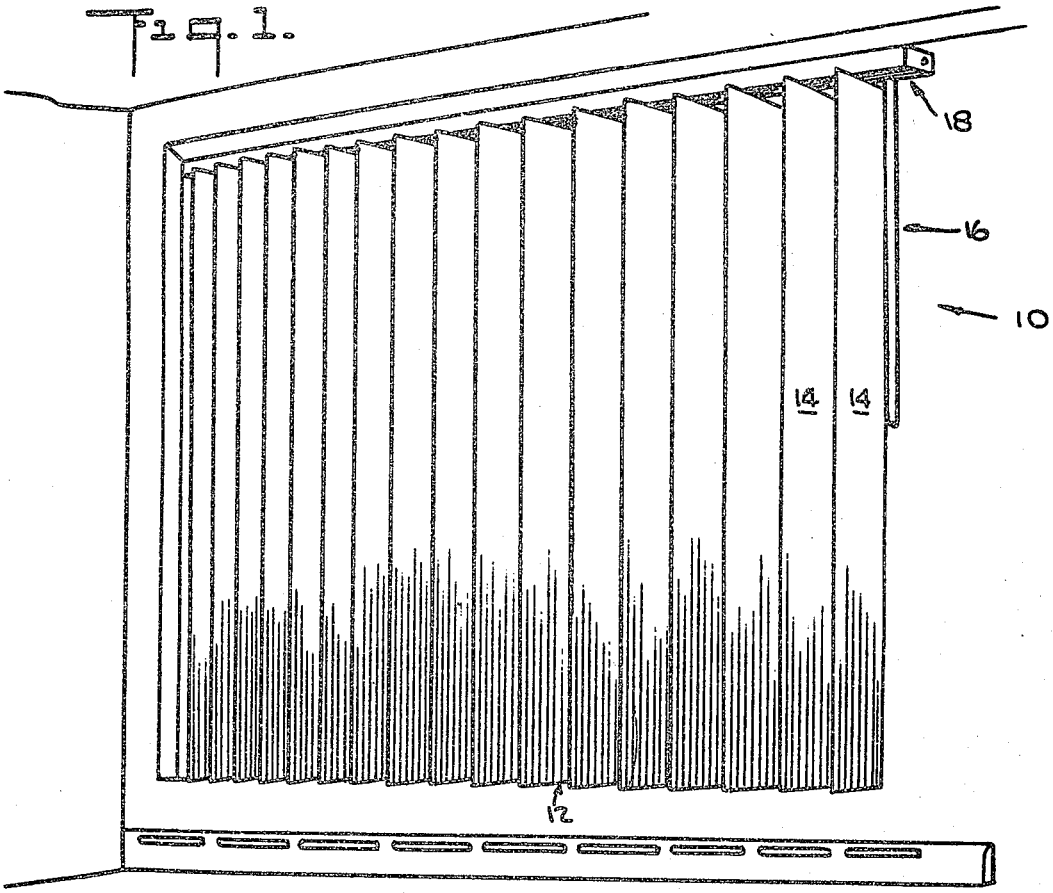
Fig. 6.
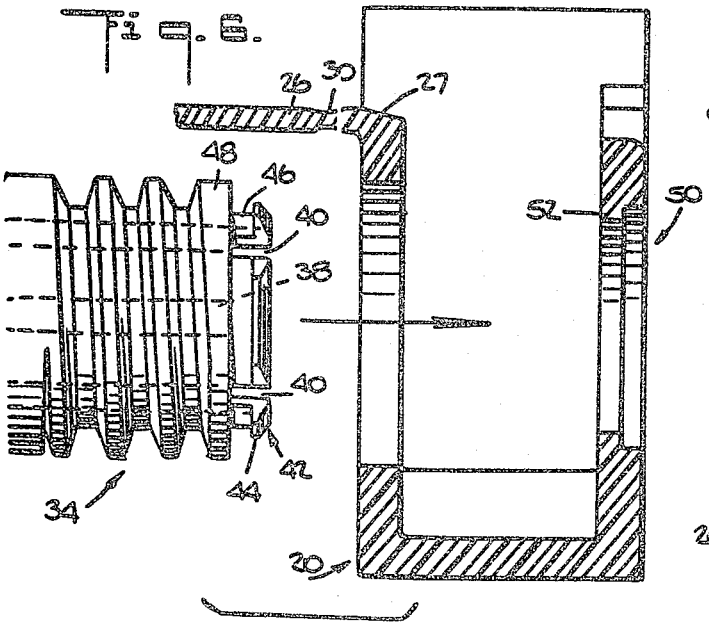
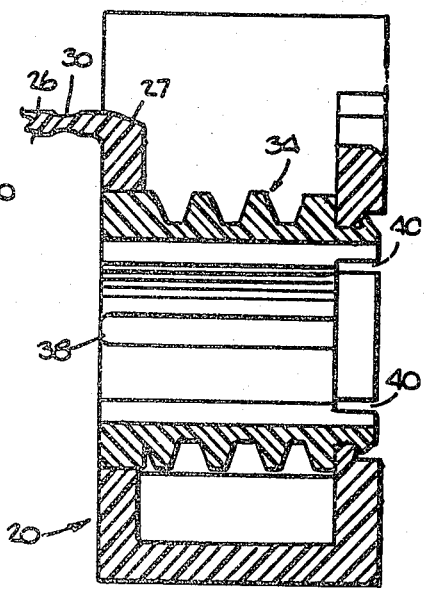
Fig. 7.

VERTICAL BLIND CONTROLS

BACKGROUND OF THE INVENTION

1. Field of the Invention

The present invention relates generally to vertical blinds and more particularly to controls for rotating and traversing vertical blinds.

2. Description of the Prior Art

Vertical blinds require controls to traverse the vanes and to rotate the vanes. Prior art actuators for the controls are usually located at opposed ends of the blinds or juxtaposed at a common end and they are not traversely movable along the blind. The traverse and rotation control actuators are typically chains or cords or one may be a rod, and whether the actuators are located at opposite ends of the blinds or juxtaposed at a common end, traversing and rotation of the vanes requires movement of one actuator, then movement of the other. Where they are located at opposite ends of the blinds, it is an inconvenience to have to walk from one end of the blinds to the other in order to make adjustments to both the traverse and rotated positions of the vanes, particularly where the traverse distance is considerable which is not uncommon in modern architecture. In addition, one quite often grasps the actuator used to traverse the vanes when he intends to rotate the vanes and vice versa, particularly when the actuators are located at a common end of the blinds. U.S. Pat. Nos. 3,996,988 and 3,343,588 both disclose vertical blinds having separate cord and chain actuators for traversing and rotating the vanes located at the same end of the blind. In both patents, the chain actuates a shaft which drives a worm and worm wheel arrangement for rotating the vanes. One prior art actuator includes a chain and clutch in which the chain either actuates rotation or traverse of the vanes depending on whether the clutch is engaged. Simultaneous rotation and traverse of the vanes is not possible with that prior art actuator and the vanes are not traversable in any rotated position. It is also inconvenient to have to engage and disengage the clutch in order to switch between rotation and traversing, particularly when it is desired to only rotate or traverse the vanes, it being necessary to either engage or disengage the clutch to accomplish this. Not only do the chain and cord type actuators of the prior art require numerous parts and are expensive and inconvenient, but they are also susceptible to jamming, cord fraying, chain breaking and other malfunctions and are cumbersome to operate, and difficult and expensive to repair, sometimes requiring the disassembly of the entire blind.

The present invention eliminates the chains and cords and associated sprockets and pullys of the prior art, overcomes the aforementioned drawbacks and disadvantages of the prior art and provides a new, economical and improved mechanism.

SUMMARY OF THE INVENTION

Vertical blinds according to the invention comprise apparatus for traversing and rotating the vanes including means for supporting the vanes, traverse means for traversing the vanes including traverse control and actuating means therefor, and rotation means for rotating the vanes including rotation control and actuating means therefor, with at least the traverse actuating means and rotation actuating means being movable along the frame of the blind. According to the invention, the vanes may be simultaneously traversed and rotated and the traverse and rotation actuating means may be located together.

In a disclosed embodiment, the vanes are supported by carrier members mounted to slide along a rod. The rotation means include coupling means disposed in the carrier members to rotatably couple the vanes to the rod whereby rotation of the rod causes the vanes to rotate. Rotation control means in the form of tubular means are included in a control housing whereby the rod may be rotated. The traverse control and the rotation control means are connected to respective actuating means in the control housing which is mounted to slide or traverse along the rod wherein sliding or traversing of the control housing and tubular means along the rod moves the carriers therealong to traverse the vanes. The actuating means for sliding the control housing and actuating the tubular means to rotate the rod are connected to the control housing and to the tubular means. In the disclosed embodiment, both the traverse and rotation actuating means comprises an actuator or control rod or wand, and the coupling means include a worm and worm wheel, the worm and carrier including means for snap-fitting the worm into the carrier member.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references apply to like parts and in which:

FIG. 1 is a perspective view of vertical blinds according to the invention;

FIG. 6 is an exploded side view, partly in section, showing the worm of the coupling means and the manner in which it is inserted in a carrier member; and FIG. 7 is a top view in section of the worm of FIG. 6 inserted in the carrier member.

DESCRIPTION OF THE PREFERRED EMBODIMENT

FIG. 1 shows vertical blinds 10 according to the invention mounted along window opening 12 with the vanes 14 completely extended and in the open position. In accordance with the invention, a single actuator or control 16 in the form of a rod or wand both actuates rotation and traverse of the vanes.

Figure 2:
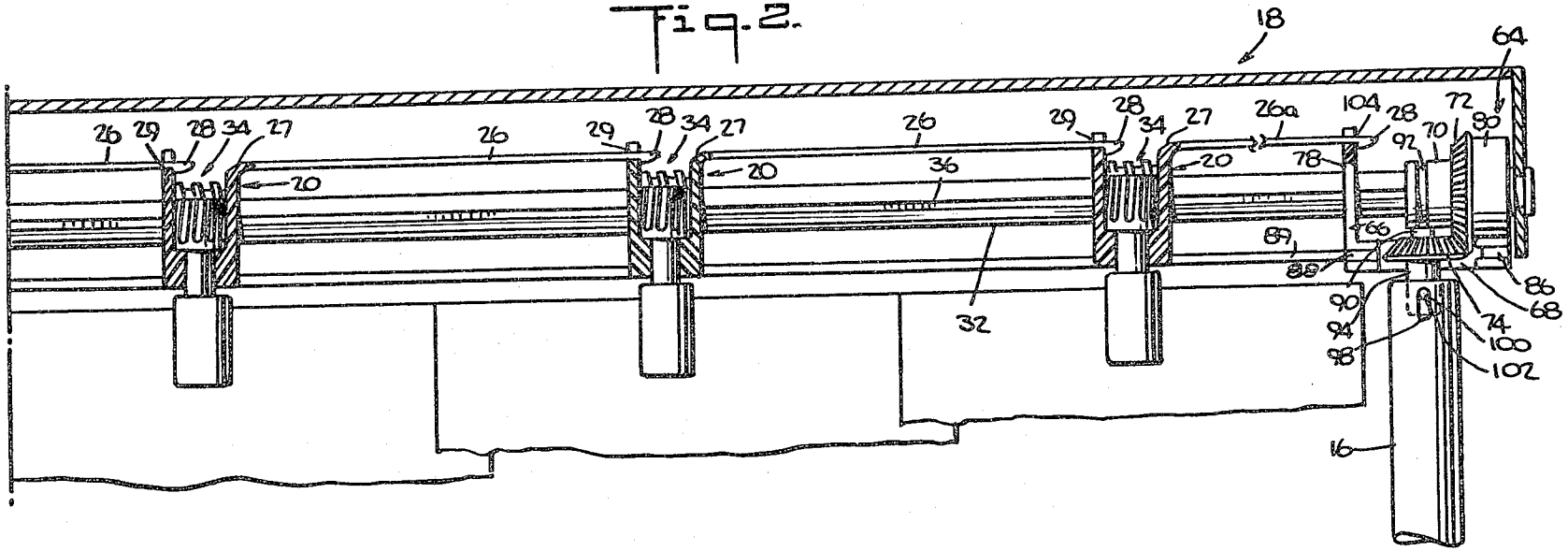
FIG. 2 is a side section view taken longitudinally through part of the upper track and support structure of the blinds of FIG. 1 showing the carrier members supporting the vanes and the means for traversing the vanes and rotating the vanes including the control and actuating means therefor according to the invention, the carrier members being maximally spaced apart to traversely extend the vanes with the vanes being in the closed position.
Figure 4:
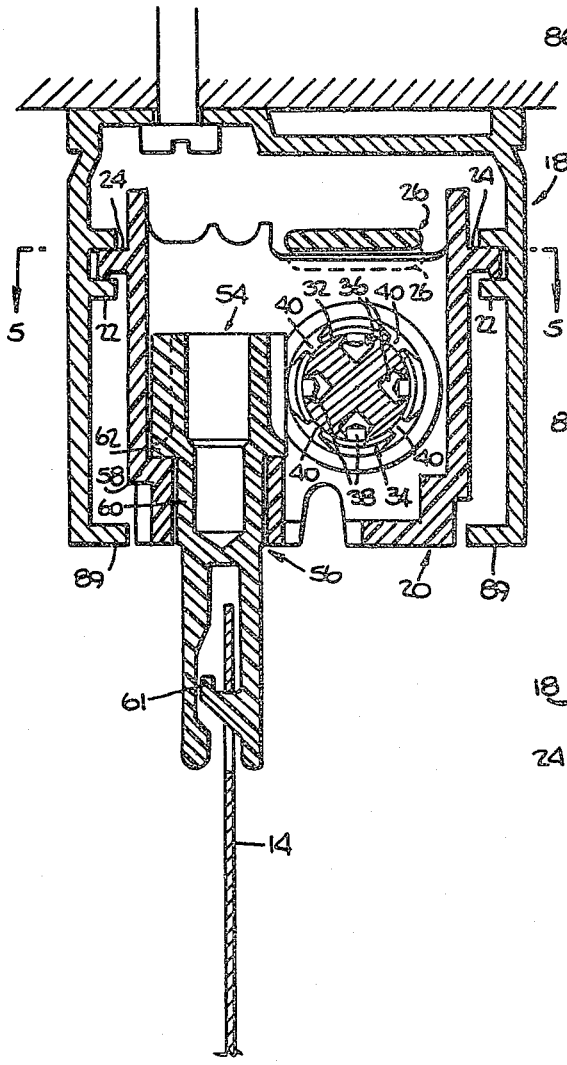
FIG. 4 is an end section view taken along line 4—4 of FIG. 3 and shows a carrier member and the coupling means including a worm and a worm wheel for rotating the vanes with the vane rotated to the closed position.
Figure 5:
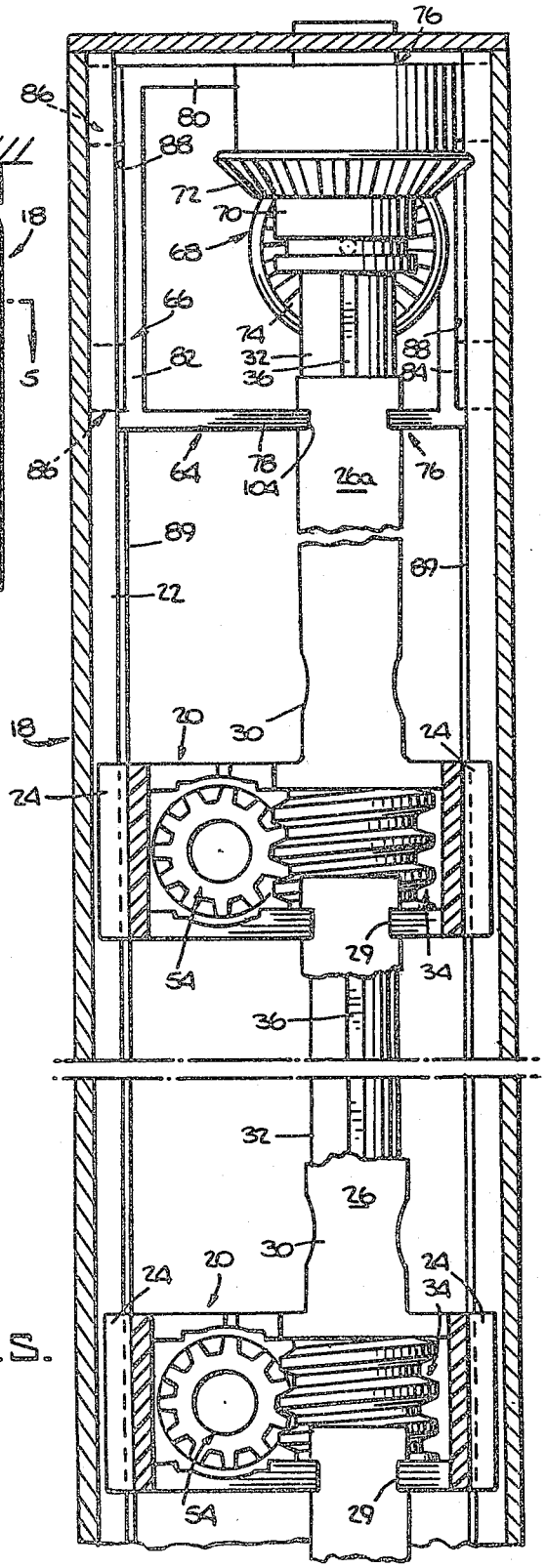
FIG. 5 is a top section view taken along line 5—5 of FIG. 4 and also shows the carrier member and coupling means of FIG. 4 as well as the structure shown in FIGS. 2 and 3.

As shown in FIGS. 2, 4 and 5, vanes 14 are supported by carrier members or carriers 20 which in turn are supported by track 18. The carriers may be those disclosed in my copending application entitled "Carrier For Vertical Blind", Application Ser. No. 834,836, filed on Aug. 15, 1977. Track 18 includes interior track raceways 22 longitudinally disposed along the interior of opposed sides of the track, and carriers 20 include L-shaped shoulders 24 projecting outwardly from opposed sides of the carriers sized to be slidably mounted within raceways 22 (FIG. 4). Movement of the carriers along the raceways accomplishes traversing of the vanes. Although not shown, a wheel and track arrangement may be ued for movement of the carriers in the track. The carriers 20 include spacers 26 which cooperate and interlock with an adjacent carrier to limit the maximum distance by which the carriers, and correspondingly the vanes, may be spaced. The carrier includes a beveled section 27 proximate the spacer and each of the spacers 26 includes a beveled tab 28 at the distal end thereof. The width of the tabs exceeds the width of slotted openings 29 in the ends of respective carriers in which an adjacent spacer is slidably disposed. Since the tab is wider than a slotted opening, the spacer cannot be axially withdrawn therefrom when the carriers are spaced apart, and the maximum distance by which the carriers may be separated is determined by the length of the spacers. The slotted opening is located towards the top of the carrier and is open at its top so that a spacer may be inserted therein. A short section 30 (FIG. 5) of the spacer is constricted in width so that the spacers may be inserted through the open tops of slotted openings of respective carriers while the remainder of the spacer is prevented from vertically leaving the slotted opening. The beveled section 27 and the bevelling at the top cooperate in assisting one spacer to slide over the other as they are being stacked. The carriers are shown maximally spaced in FIG. 2 and are overlapped when the vanes are in the closed position as shown.

A rotation rod 32 is longitudinally disposed within track 18 and extends through carriers 20. The rod is supported and journaled in opposed ends of the track for rotation thereof. Worms 34 are disposed in carriers 20 and the rotation rod 32 extends through the worms. Female splines 36 extend axially along rotation rod 34 and ribs or male splines 38 extend axially along the inner circumference of worm 34 (FIG. 4). At least one set of splines is required and four sets are shown spaced equally about the outer circumference of the rotation rod and the inner circumference of the worm, respectively. The splines are sized such that the male splines are slidably engaged within the female splines. Thus, the worm will rotate with the rotation rod but is slidable with respect thereto. As shown in FIGS. 6 and 7, the worm 34 is snap-fitted into the carrier 20. To this end, worm 34 is axially slotted at one end thereof intermediate splines 38. Four equally spaced slots 40 are provided as shown in FIG. 4. The end portion 42 of the worm in which the slots are disposed is of reduced outer diameter and terminates in an annular, beveled rib 44 (FIG. 6). An annular slot 46 is formed between the annular rib and the major diameter 48 of the worm screw thread. About opening 50 in carrier 20 is disposed another annular rib 52 sized to be engaged within annular slot 46 (FIG. 6). The worm is seated in a carrier by applying a force in the direction of the arrow sufficient to flex the portions of the end portion 42 separated by slots 40 radially inwardly so that the annular rib 44 is forced past the annular rib 52 in the carrier. The beveled edge of rib 44 assists in the flexing of the separated end portions. The worm is shown seated in FIG. 7. Opening 50, the worm major diameter 48, the reduced diameter end portion 42, and the annular ribs are all sized so that the worm is rotatable within the carrier. Referring again to FIG. 2, rotation rod 32 is mounted in track 18 extending through the carriers 20 and worms 34, with the worms and rotation rods engaged for common rotation by means of the splines.

Also disposed in carriers 20 for rotation therein are worm wheels 54. As shown in FIG. 4, carriers 20 have a third opening 56 and adjacent shoulders 58. Secured to worm wheel 54 is bushing 60 which is sized and disposed to rotate within opening 56. The bushing is of reduced di- ameter compared to the worm wheel and, as a result, the end of the worm wheel adjacent the bushing forms a shoulder 62 which is supported by shoulder 58 of the carrier. Bushing 60 includes an axially slotted section having a hook 61 and vanes 14 include a slot (not shown) for securing the vanes to the bushings. The openings in the carriers and the worms and worm wheels are sized and disposed so that the worms and worm wheels mesh, whereupon rotation of worms 30 cause worm wheels 54 and vanes 14 to rotate.

Figure 3:
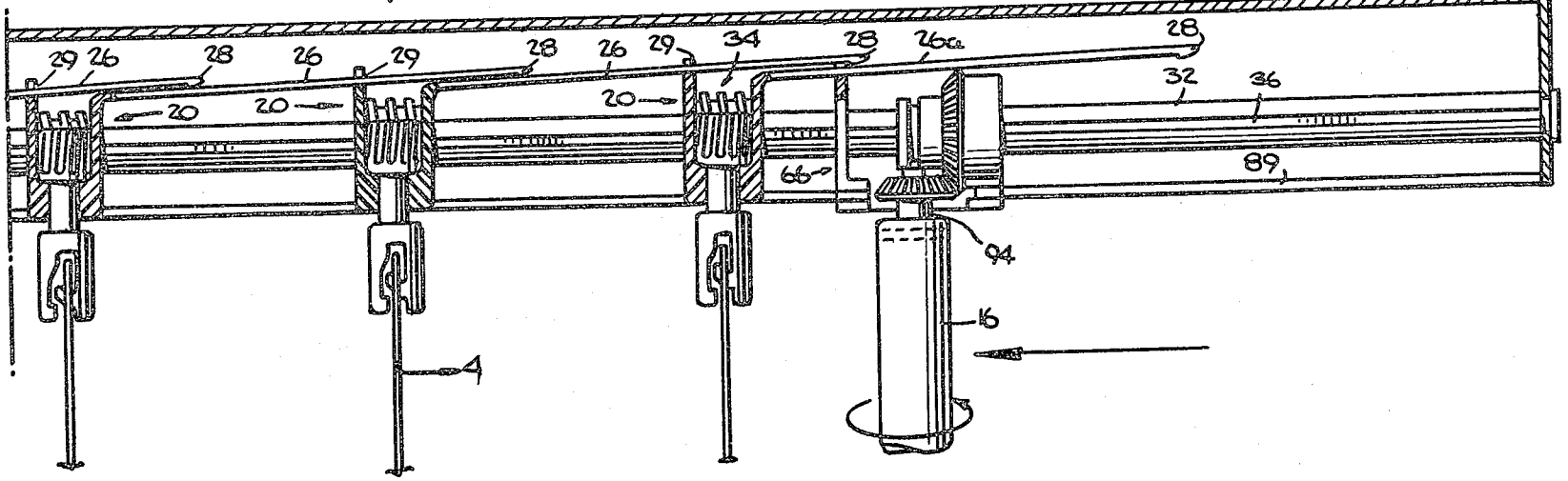
FIG. 3 is a side section view similar to that of FIG. 2 showing the vanes rotated to the open position and the carrier members moved to the left and partially stacked to partially traverse the vanes.

Traverse and rotation of the vanes are controlled and actuated by means of control assembly 64 and actuator or control rod or wand 16 (FIGS. 2, 3 and 5). Control assembly 64 for effecting rotation and traverse of the vanes includes control housing 66 and sliding gear assembly 68 which comprises ring or tubular member 70 and bevel gears 72, 74. Housing 66 is in the form of a box having an open top. Openings 76 are disposed in opposed ends 78, 80 of the housing and are sized so that rotation rod 32 may be slidably moved therein (FIG. 5). Each side 82, 84 of the housing at the bottom thereof has two pairs of flanges 86 on the exterior thereof, each pair of which on a respective side being spaced apart and located towards opposed ends of the housing. The two flanges of each pair are vertically spaced to form a slot 88 (FIG. 2). The slots 88 and a track flange 89 located at the bottom of the track are sized so that housing 66 is slidably mounted on the flange for movement along the track. Referring now to FIG. 2, ring 70 includes axial ribs or male splines (not shown) circumferentially spaced about the interior thereof to engage splines 36 of the rotation rod as described hereinabove for worm 34. Thus, rotation of ring 70 will rotate rotation rod 32 while permitting the ring to be slid therealong. Bevel gear 72 is part of or rigidly mounted on one end of the ring 70 to rotate therewith. Extending from ring 70 is shaft 90 which is journaled into the ring so that the shaft may be rotated along its axis relative to the ring. Ring 70 includes circumferential slot 92 in which shaft 90 is journaled so that the ring may be rotated along the axis of rotation rod 32 relative to the shaft. Bevel gear 74 is part of or rigidly mounted on shaft 90 and is rotatable therewith. Shaft 90 includes an extended portion 94 of larger diameter which is journaled into the bottom of the housing to maintain bevel gear 74 meshed with gear 72.

Wand 16 and shaft portion 94 are universally joined. Wand 16 is hollow or it may be bored at one end thereof and includes thereat opposed axial slots 98. The shaft portion 94, disposed within the interior of the control rod, includes radial hole 100 therethrough and is pivotally connected to the wand by means of pin 102 extending through slots 98 and hole 100. Thus, the wand may be pivoted with respect to the shaft 90 and housing 66 and rotated to rotate the shaft and, correspondingly, bevel gear 74. End 78 of housing 66 includes a slotted opening 104 for slidably receiving the spacer 26*a* of the adjacent carrier. Slotted opening 104 is similar to the slotted openings described for the carriers.

The vanes 14 are traversed and rotated as follows. Referring to the left-parting arrangement of FIGS. 2 and 3, the vanes are traversed by sliding housing 66 along track 18 by means of wand 16. When traversing to the right, the tab 28 of the spacer 26*a* immediately adjacent to the housing will be engaged by slotted opening 104 in the housing; the tabs of next adjacent carriers will then be engaged in the slotted openings of respective carriers whereby the spacers will be successively engaged, thereby moving the carriers and vanes to the right. When traversing to the left, the spacer of the carrier immediately adjacent to the housing slides through slotted opening 104 until end 78 contacts the carrier, and continued movement of the housing to the left will move the carrier. The spacers of the other carriers will similarly move through the slotted openings of adjacent carriers and successive carriers will be contacted and stacked as the housing is further moved towards the left. The vanes are rotated merely by rotating wand 16. Rotation of wand 16 causes shaft 90 and bevel gear 74 to rotate which in turn cause bevel gear 72 and rotation rod 32 to rotate. Rotation of rod 32 causes worm 34 and worm wheel 54 to rotate which in turn rotate bushing 60 and vanes 14. It is understood that housing 66 and wand 16 will be located towards the left end of a right-parting blind and that two housings and wands are employed in a biparting blind. Additionally, the housing and wand for a right or a left-parting blind need not be located at the extreme end of the blind.

Vanes 14 may be rotated in any traverse position of the control housing 66. Preferably, the vanes are in the open position when they are traversed.

As described hereinabove, the wand 16 is operative to actuate both rotation and traversing of vanes 14 and may do so simultaneously. Additionally, the means for actuating the traversing and rotation of the vanes are always located together. The single actuator or wand according to the invention eliminates light leakage since the wand and control housing need not be positioned at the extreme end of the blind.

It is within the contemplation of the present invention that means other than ring 70 and bevel gears 72, 74 operate to rotate the vanes while the means for actuation thereof is located with the means for actuating the traversing of the vanes. For example, ring 70 may be replaced by a hollow drum and the bevel gears by a cord wound round the drum so that rotation of the cord causes rotation of the drum. The drum is slidably secured to the rotation rod to effect rotation thereof in a manner similar to that for ring 70. The hollow wand 16 is universally secured to the drum and the cord is run through the interior of the wand so that the cord and wand are always located together. The bevel gears may also be replaced by a miter gears or a worm and worm wheel arrangement.

The advantages of the present invention, as well as certain changes and modifications of the disclosed embodiment thereof, will be readily apparent to those skilled in the art. It is the applicant's intention to cover by his claims all those changes and modifications which could be made to the embodiment of the invention herein chosen for the purposes of the disclosure without departing from the spirit and scope of the invention.

What is claimed is:

1. Apparatus for traversing and rotating vertical blinds comprising:

support means for supporting the blind vanes including horizontally-extending track means and vane carrier means supported by said track means disposed to be horizontally traversed therealong, the vanes being supported by said carrier means;

traverse means for traversing the vanes including traverse actuating means therefor; and rotation means for rotating the vanes including rotation actuating means therefor, a horizontally-extending rotation rod and first coupling means in said carrier means coupling the rotation rod and the vanes for rotating the vanes in response to rotation of the rotation rod;

said traverse actuating means and said rotation actuating means including control means coupled to said traverse actuating means and to said rotation actuating means, said control means being traversable along said rotation rod, and said traverse and rotation actuating means being located together and traversable with one another.

2. The apparatus recited in claim 1, wherein said control means are maintained at least in part in a common housing.

3. The apparatus recited in claim 1, wherein said control means comprises tubular means mounted on said rotation rod for traversable movement therealong, said rotation rod being engaged by said tubular means to rotate therewith.

4. The apparatus recited in claim 3, wherein said traverse actuating and said rotation actuating means comprise an actuating rod connected to said tubular means and wherein said control means include second coupling means coupling said actuating rod to said tubular means for rotating said rotation rod upon rotation of said actuating rod.

5. The apparatus recited in claim 4, and further comprising means universally connecting said actuating rod and said tubular means.

6. The apparatus recited in claim 4, wherein said control means are maintained at least in part in a common housing and wherein said second coupling means comprises a driven bevel gear rigidly connected to said tubular means and a meshing drive bevel gear rotatably supported in said housing by said tubular means and connected to said actuating rod to rotate therewith.

7. The apparatus recited in claim 1, wherein said first coupling means comprises worm means mounted in said carrier means, said rotation rod being slidably inserted in said worm means and being engaged by said worm means to rotate therewith, and worm wheel means connected to the vanes and mounted in said carrier means to mesh with said worm means.

8. The apparatus recited in claim 7, wherein said carrier means comprises a generally hollow carrier member.

9. In vertical blinds including carrier members for supporting the vanes, a horizontally-extending track traversably supporting the carrier members and a rotation rod horizontally-extending through the carriers for rotating the vanes, the improvement comprising tubular means traversably mounted on the rod for traversable movement therealong, means for engaging said tubular means to the rod for rotation of the rod upon rotation of said tubular means, and actuating means coupled to said tubular means for:

(a) traversing said tubular means along the rod to traverse the carriers and thereby traverse the vanes; and (b) for rotating said tubular means to thereby rotate said rod and the vanes; said actuating means being traversable to traverse said tubular means; and coupling means coupling said actuating means to said tubular means.

10. The improvement recited in claim 9, wherein said actuating means comprises an actuating rod connected to said tubular means.

11. The improvement recited in claim 9, wherein said coupling means includes means universally connecting said tubular means and said actuating means.

12. The improvement recited in claim 10, wherein said tubular means include a housing in which said tubular means are mounted, said housing being traversable with said tubular means on said rotation rod.

13. The improvement recited in claim 12, wherein said coupling means comprises a first bevel gear connected to said tubular means and a second meshing bevel gear connected to said actuating rod.

14. The improvement recited in claim 13, wherein said coupling means comprises universal means connecting said second bevel gear and said actuating rod.

* * * * *

US004316493B1

REEXAMINATION CERTIFICATE (3238th)

United States Patent [19] [11] B1 4,316,493

Arena [45] Certificate Issued Jun. 24, 1997

[54] VERTICAL BLIND CONTROLS

[75] Inventor: Joseph P. Arena, Great Neck, N.Y.

[73] Assignee: Newell Operating Company, Freeport, Ill.

Reexamination Request:
No. 90/004,251, May 28, 1996

Reexamination Certificate for:

| | |
|---|---|
| Patent No.: | **4,316,493** |
| Issued: | **Feb. 23, 1982** |
| Appl. No.: | **824,834** |
| Filed: | **Aug. 15, 1977** |

[51] Int. Cl.[6] ..... E06B 9/36

[52] U.S. Cl. ..... 160/168.1 V; 160/176.1 V; 160/900

[58] Field of Search ..... 160/168.1 V, 176.1 V, 160/900, 178.1 V, 173 V

[56] References Cited

U.S. PATENT DOCUMENTS

| | | | |
|---|---|---|---|
| 2,625,219 | 1/1953 | Peck | 160/176.1 V X |
| 2,860,636 | 1/1959 | Klenz | 160/900 X |
| 2,996,115 | 8/1961 | Klenz | 160/900 X |
| 3,159,204 | 12/1964 | Kruell . | |
| 3,208,507 | 9/1965 | Breen | 160/176.1 V X |
| 3,280,891 | 10/1966 | Eldridge, Jr. et al. | 160/900 X |
| 3,367,390 | 2/1968 | Toti . | |
| 3,878,877 | 4/1975 | Bruneau et al. . | |

FOREIGN PATENT DOCUMENTS

| | | |
|---|---|---|
| 7539579 | 4/1976 | Germany . |
| 2526275 | 12/1976 | Germany . |
| 1377279 | 11/1973 | United Kingdom . |
| 1337279 | 11/1973 | United Kingdom . |

*Primary Examiner*—Blair Johnson

[57] ABSTRACT

Vertical blinds having commonly housed and traversely movable controls for controlling the traverse and rotation of the vanes are disclosed. In a disclosed embodiment, the vanes are supported by carrier members, and a rotation rod extends through the carrier members. The carrier members are slideable along the rotation rod. A control assembly is mounted to slide along and also rotate the rotation rod. Sliding of the control assembly along the rotation rod slides the carrier members to thereby traverse the vanes, and actuation of the control assembly rotates the rotation rod and the vanes. The control assembly includes meshing bevel gears, one of which is coupled to an actuating rod or wand and the other to the rotation rod whereby rotation of the wand causes rotation of the vanes. The control assembly is slid by means of the wand which is universally connected to the control assembly. The wand is thus a unitary control for actuating both traverse and rotation of the vanes.

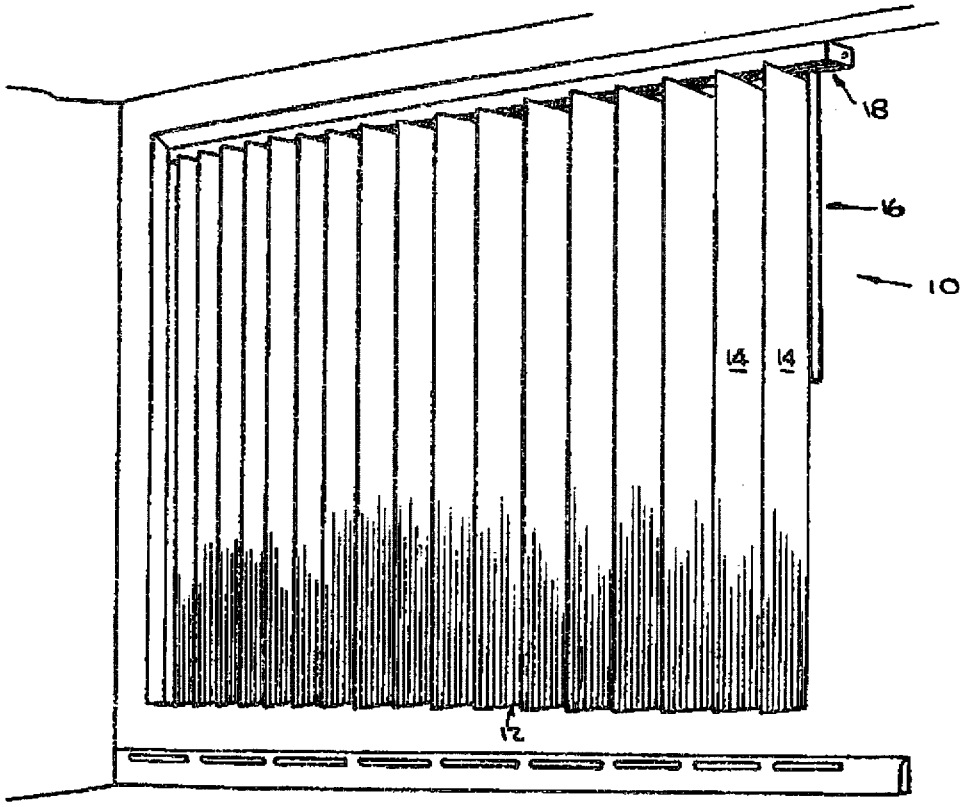

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 10 is cancelled.

Claims 1, 4, 9, and 12 are determined to be patentable as amended.

Claims 2, 3, 5–8, 11, 13 and 14 dependent on an amended claim, are determined to be patentable.

1. Apparatus for traversing and rotating vertical [blinds] *blind vanes* comprising:

support means [for] supporting [the] blind vanes including horizontally-extending track means and vane carrier means supported by said track means disposed to be horizontally traversed therealong, the vanes being supported by said carrier means;

traverse means for traversing the vanes including traverse actuating means therefor; and rotation means for rotating the vanes including rotation actuating means therefor, a horizontally-extending rotation rod and first coupling means in said carrier means coupling the rotation rod and the vanes for rotating the vanes in response to rotation of the rotation rod, *said rotation rod being located in a vertical plane;* said traverse actuating means and said rotation actuating means including control means coupled to said transverse actuating means and to said rotation actuating means, said control means being traversable along said rotation rod, and said traverse and rotation actuating means being located together and traversable with one another, *said traverse actuating means and said rotation actuating means comprise an actuating rod extending directly and vertically below the rotation rod and being located in said vertical plane.*

4. The apparatus recited in claim 3, wherein said [traverse actuating and said rotation actuating means comprise an] actuating rod *is* connected to said tubular means and wherein said control means include second coupling means coupling said actuating rod to said tubular means for rotating said rotation rod upon rotation of said actuating rod.

9. In vertical blinds including carrier members for supporting [the] vanes, a horizontally-extending track traversably supporting the carrier members and a rotation rod horizontally-extending through the carriers for rotating the vanes, *said rotation rod being located in a vertical plane*, the improvement comprising tubular means traversably mounted on the rod for traversable movement therealong, means for engaging said tubular means to the rod for rotation of the rod upon rotation of said tubular means, and actuating means coupled to said tubular means for:

(a) traversing said tubular means along the rod to traverse the carriers and thereby traverse the vanes; and (b) for rotating said tubular means to thereby rotate said rod and the vanes; said actuating means being traversable to traverse said tubular means; and coupling means coupling said actuating means to said tubular means*; and said actuating means comprises an actuating rod connected to said tubular means, wherein said actuating rod extends directly and vertically below said rotation rod and being located in said vertical plane.*

12. The improvements recited in [claim 10] *claim 9*, wherein said tubular means include a housing in which said tubular means are mounted, said housing being traversable with said tubular means on said rotation rod.

* * * * *